United States Patent [19]

Storm

[11] 4,162,870

[45] Jul. 31, 1979

[54] HORIZONTAL STACKER FOR BAKED GOODS AND THE LIKE

[76] Inventor: Donald W. Storm, 5857 Upper Straits Blvd., Orchard Lake, Mich. 48033

[21] Appl. No.: 835,450

[22] Filed: Sep. 22, 1977

[51] Int. Cl.[2] ..... B65G 57/00

[52] U.S. Cl. ..... 414/107; 53/247; 414/48

[58] Field of Search ..... 214/7, 1 BD, 8.5 A; 53/26, 61, 147, 152, 153, 162, 166, 244, 247, 260, 299

[56] References Cited

U.S. PATENT DOCUMENTS

| | | | |
|---|---|---|---|
| 2,441,757 | 5/1948 | Doering et al. | 53/123 |
| 3,090,504 | 5/1963 | Britton et al. | 214/7 |
| 3,182,822 | 5/1965 | Frost | 214/7 |
| 3,499,263 | 3/1970 | Stanley et al. | 214/7 X |
| 3,908,812 | 9/1975 | Graff | 53/247 X |
| 3,942,303 | 3/1976 | Kristiansen | 53/247 X |

*Primary Examiner*—Frank E. Werner
*Attorney, Agent, or Firm*—Cullen, Sloman, Cantor, Grauer, Scott & Rutherford

[57] ABSTRACT

A stacker for horizontally stacking a group of roughly round, generally flat shaped, irregularly dimensioned items, such as English muffins, doughnuts and the like types of baked goods, said stacker including a horizontally extending frame formed of opposite side and bottom wire-like elements for supporting the items on their edges, i.e., horizontally axially aligned. A piston is arranged between the elements for applying a horizontally axially directed force to the stack of items from one direction towards the opposite, item loading, end of the frame. A swinging barrier located at the loading end of the frame forms a stop to hold the stack against the force of the piston. A pivoting loading arm arranged at the loading end of the frame receives the items, one by one, in a horizontal position and pivots each item into vertical position and upon the loading end of the frame, causing the barrier to momentarily swing out of the way during the loading, so that the barrier may swing down to act as a stop for the most recently added item. The bottom element may be moved to thereby release the items and cause them to gravity drop as complete stack.

3 Claims, 7 Drawing Figures

HORIZONTAL STACKER FOR BAKED GOODS AND THE LIKE

BACKGROUND OF INVENTION

A problem that has existed in the production baking industry involves the stacking or alignment of rounded, relatively flat, baked goods such as English muffins, doughnuts and the like types of items. That is, such items are normally baked in such a way that they emerge from the oven or cooking equipment in a generally horizontal plane, i.e., upon a suitable conveyor. For packaging purposes, groups of such items, as for example a half dozen or dozen or so, must be stacked or aligned and then placed into boxes or bags.

Rapid, efficient alignment or stacking of such type of goods has been done primarily by hand, although various efforts have been made from time to time to develop machinery for that purpose. Since the items are easily broken, are typically packaged while they are still warm, may include coatings or frostings or the like which complicate the handling of them, etc., stacking is a difficult problem to handle with machinery.

Thus, the invention herein seeks to solve the stacking problem by means of providing a mechanism which receives the baked items, one by one, in the horizontal plane, then swings the item into the vertical plane to form a horizontally axised stack by adding such items one by one to the stack until a complete stack is formed. At that point, the mechanism releases the stack as a group into a box or into further equipment for bagging or the like. By handling the baked goods on a one by one basis, and simply adding them to the stack one by one, the items do not rub together or otherwise present problems which might be caused by sticky coatings, surface friction, etc. and in addition will not be broken or damaged even though warm and fragile.

The mechanism herein contemplates a simplified unit which can be used either as a single unit or in banks or groups of such units for multiple stacking and packaging of stacks. Thus, the mechanism essentially replaces manual labor for packaging of such items.

SUMMARY OF INVENTION

The invention herein comtemplates a stacking mechanism comprising a horizontally elongated frame having a pressure applying member at one end and a moveable barrier at the opposite end, between which a stack of items may be formed. The items are placed into the stack, one by one, by means of a pivoting arm mechanism which receives an item in the horizontal plane, and swings it into the vertical plane, depositing it within the frame and simultaneously momentarily moving the barrier out of the way for addition of the item to the stack so that the barrier may then return to its normal stop position when the arm returns to the horizontal position for the next item to be loaded. The frame typically includes a bottom portion or element which may be moved at predetermined times so as to permit gravity dropping or feeding of the complete stack. This permits dropping the stack into an open box located beneath the frame or into appropriate bagging mechanisms, etc.

The construction comprises relatively few parts which are simple in construction, as well as open, so that they can be easily cleaned and maintained and thus, reduce the possibilities of collecting or holding unwanted materials such as crumbs or the like. These characteristics are important in the bakery industry where sanitary conditions are necessary and where the operation of the equipment must be as maintenance free as possible.

A basic object of the invention herein is to move a stream of flat, generally rounded objects, such as soft goods of the doughnut, English muffin or the type variety, from the horizontal position into horizontally axially aligned stacks of predetermined numbers so that the stacks can then be handled further in packaging these.

The stacking mechanism herein leads itself to use with various types of packages and conveying systems for moving the packages and for receipt of the stacks of items. For example, appropriate open top boxes can receive the stack dropped by gravity therein. Alternatively, bags can be positioned, with suitable bagging mechanisms, to receive the stacks, etc. Since the invention herein is concerned with the stacking mechanism itself, the types of packaging and the devices for handling the stacks and assemblying them into the packages are not described herein other than in general terms.

These and further objects and advantages of this invention will become apparent upon reading the following Description, of which the attached drawings form a part.

DETAILED DESCRIPTION

Figure 1:
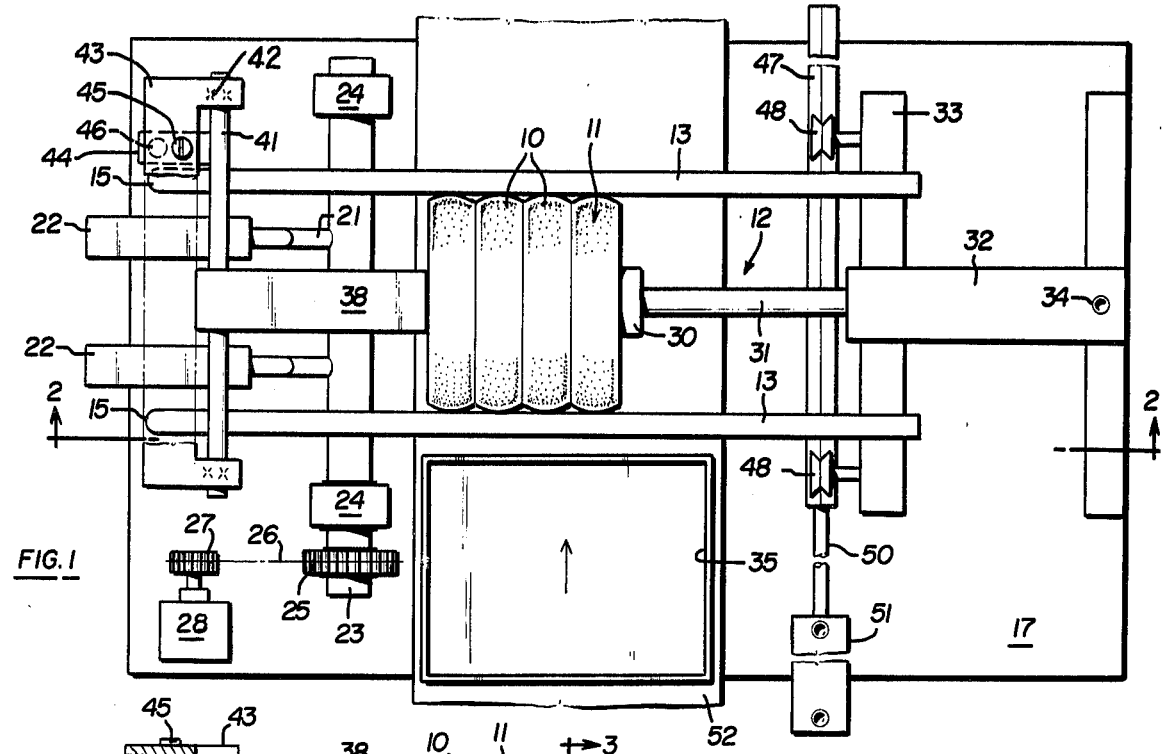
FIG. 1 is a top, plan view of the stacking mechanism herein.

The essential purpose of the mechanism herein is to group or stack together a number of individual items 10 which are characterized by being irregular in dimension and shape, but being generally round or roundish or disk-like and relatively flat and of a soft and easily breakable nature. The mechanism herein is essentially for the purpose of handling baked goods, such as English muffins, doughnuts and similarly shaped baked items. However, it can be used for other types of items which, although not baked goods, have the same general types of problems and shapes for which this mechanism may be used to advantage.

The items 10 normally come from a baking or cooking means upon a conveyor which will align and feed the items one by one to the mechanism herein. The conveyor and the feeding portions are omitted, since they form no part of thhe invention herein. However, the items are added one by one to a horizontally arranged stack 11 until a predetermined number of items are reached, at which point the entire stack or group may be handled as a single entity for packaging purposes, i.e., placing into a box or bag, etc.

A number of stacks can be formed simultaneously by arranging a number of these mechanisms side by side. For example, in boxing English muffins, two of these stacking mechanisms can be arranged side by side, each to form a stack of six so that a total of twelve (two stacks of six each) are simultaneously assembled for positioning into a box of one dozen. For simplicity in illustrations and explanations, only one of the mechanisms is shown in the drawings and described here, it being understood that additional mechanisms would be of similar construction.

Referring to the drawings, the stack of items are formed in a frame 12 which is preferably made up of parallel side wire-like elements 13 and a bottom wire-like support element 14 to form an elongated, open frame.

The elements 13 are curved downwardly to form guide rail portions 15. Likewise, the bottom support element 14 is provided with a separate, unconnected, bottom guide rail portion 16. The lower ends of the curved elements are fastened to a horizontal support table or frame 17 upon which the entire mechanism is mounted. The table or frame is shown schematically since suitable support frames can be provided by those skilled in the art.

The curved element ends form the loading end of the stacking frame. For loading the items into the frame, a load arm 20 is provide, which arm is made of a pair of bent wire-like elements 21 having narrow pads or strips 22 fastened on their outer ends and their inner ends secured to a transverse shaft 23 mounted within bearings 24 fastened to the support table or frame 17.

The shaft 23 may be rotated by some suitable rotating mechanism, as for example a sprocket 25 connected through a chain 26 to another sprocket 27 mounted on a reversible motor 28. Thus, operation of the motor in the predetermined direction, causes the shaft 23 to rotate ¼ turn to thereby tilt the arm from the position wherein the pads are horizontal into a position where the pads are substantially vertical. Alternatively, a conventional pneumatically operated cylinder-piston arrangement connected through a piston rod, and link to the shaft 23, could be used. This is not illustrated, as such devices as known. A Bimba Model MRS-244-DXPZ motor is one example of a conventional motor 28 which is suitable for causing the load arm 20 to rotate ¼ turn into the dotted position shown in FIG. 2 and then return to its horizontal load position for another item 10.

A piston or plunger 30 is arranged within the frame 12 and is mounted upon a piston rod 31 received within a conventional pneumatically operated cylinder 32 mounted upon a support frame 33. Compressed air supplied through a compressed air inlet 34 operates an internal piston 35 to cause the piston rod 31 and the plunger 30 to move in a direction axially of the frame towards the loading end thereof for applying a continuous, but low level force upon the stack of items contained within the frame. The force is enough to hold the stack without compressing the items, and the plunger retracts each time another item is added to the stack, so as to maintain the continuous, low pressure. A Bimba Model 0910-DP SS Rod air cylinder is one example of a conventional pneumatically operated cylinder 32 which is suitable for applying continuous, but low level force, upon the stack of items 10 contained within support frame 33.

At the loading end of the frame, a barrier or stop 38 is mounted. Such barrier is formed of a long narrow metal strip bent into a sloped bottom edge portion 39 and a normally vertically arranged stop edge portion 40 which engages the stacked item nearest to the loading end of the frame.

The barrier is mounted upon a transverse shaft 41 secured within a pair of opposed bearings 42 connected to a transverse strip or plate 43.

A finger-like extension 44 is fastened to the shaft 41 and is engaged by a stop screw 45 and is pulled against the stop screw by means of a coil spring 46. Thus, the barrier tends to normally remain in the position shown in FIG. 2, i.e., stopping the load end of the stack against the pressure or force applied by the plunger 30.

Figure 2:
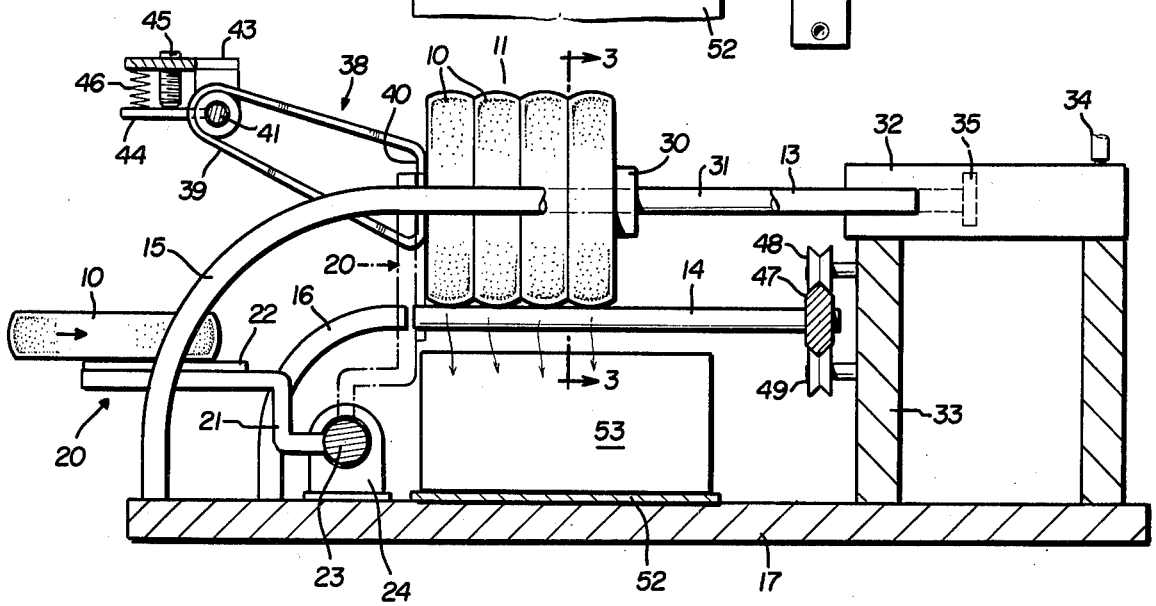
FIG. 2 is an elevational view, partially in cross section, taken in the direction of arrows 2—2 of FIG. 1.
Figure 6:
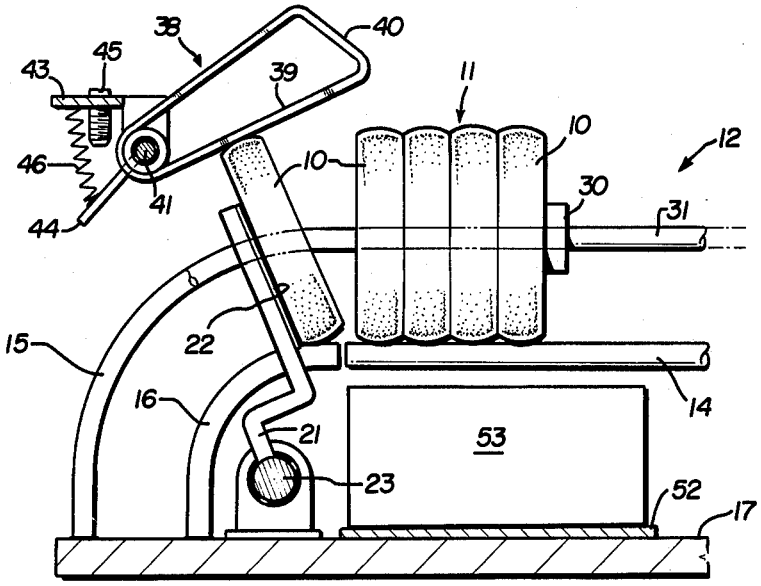
FIG. 6 is a fragmentary, elevational view, showing the addition of an item to the stack with the concomitant movement of the barrier during the loading.

In normal operation, the items to be stacked arrive on a one by one basis, in a horizontal plane, and are placed upon the pads 22 of the load arm 20 (see FIG. 2). Then the shaft 23 of the load arm is rotated ¼ turn to cause the arm to pivot into the dotted position shown in FIG. 2, i.e., with the pads approximately vertical. As the arm pivots (see FIG. 6) the upper edge of the item engages the sloped portion 23 of the barrier 38, causing the barrier to rise upwardly, out of the way, to clear the path for the item.

When the item reaches the point where it is approximately vertical, i.e., it forms the last added item in the stack, the barrier, due to the coil spring 46, drops back into position to where its vertical face portion 40 forms a back-up or stop for the stack against the pressure of the plunger 30.

As mentioned above, the pressure upon the plunger, must be relatively light due to the nature of the goods, i.e., soft and easily crushable. Thus it is desired to have a substantially uniform pressure applied by the plunger by using an appropriate pneumatic cylinder system, such as the Bimba Model 0910-DP, which keeps the pressure relatively uniform as the plunger 30 moves towards the cylinder 32 due to the addition of each stacked item. This kind of pneumatic cylinder arrangement is commercially available and is known to those skilled in the art and thus no further description is needed here.

Once the single item is added to the stack, the arm, due to reversing of the drive means, such as the motor, drops back into its original, horizontal position, for receiving and loading the next item. Thus, one by one, items are added to the stack until a predetermined number is reached, as for example six or twelve, or whatever the case may be for packaging purposes.

Once the stack is complete, the bottom support frame element is removed so that the items can gravity drop out of the frame, as for example into a package or bag. The movement of the lower frame element is accomplished by providing a transverse rail 47 supported between upper and lower guide rollers 48 and 49 and connected by a piston rod 50 to a pneumatic cylinder 51 which, when actuated, causes the rail to reciprocate. When the rail reciprocates in one direction, it moves the bottom wire-like frame element sideways, out from underneath the stack so that the stack will gravity fall.

Suitable controls may be provided for automatically actuating the pneumatic system to move the rail when the predetermined number of items are in the stack. Such mechanism would also operate the pneumatic cylinder 32 to cause the plunger to back away from the stack at about the same time as the transverse movement of the rail takes place so as to relieve the pressure which holds the stack between the plunger 30 and barrier or back-up 40. Such types of controls are commercially available to those skilled in the art. An example of a suitable cylinder and controls is the Bimba Model 0910-DP.

Figure 7:
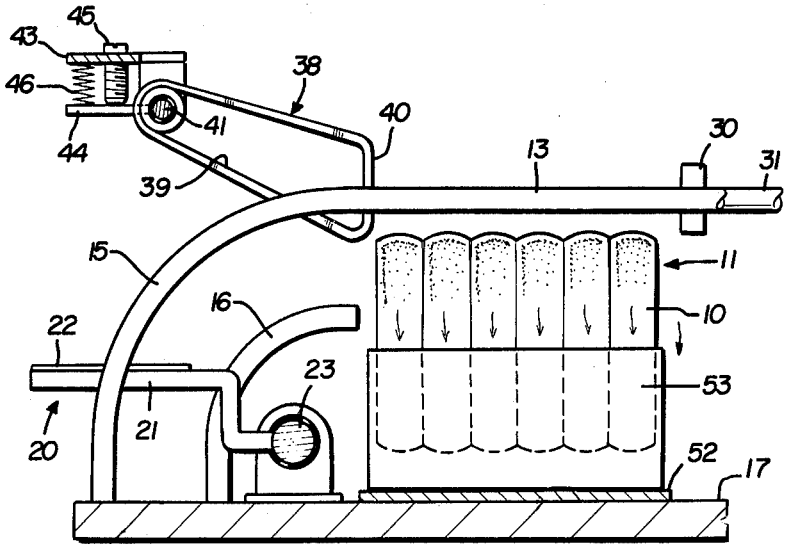
FIG. 7 is a view similar to FIG. 6, but showing the stack gravity dropping into a package or open box.

In the drawings herein, the stacks are shown as being gravity dropped downwardly towards a conveyor belt operating transversely of the stacking frames and carrying open-top boxes 53. Thus, the stack simply drops into the open box as is illustrated in FIG. 7 where the stack is partially within the box, and then the box is carried off by the conveyor 52 for further handling.

Instead of using a boxing mechanism, an appropriate bagging system can likewise be used for positioning the stack into a bag which can then be sealed, all in the known manners using known mechanisms.

Figure 3:
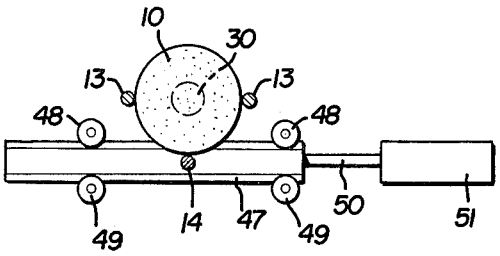
FIG. 3 is a schematic view showing a baked item, such as a muffin, confined within the support frame.
Figure 4:
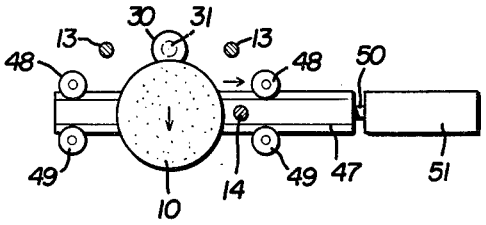
FIG. 4 is a view similar to FIG. 3, but showing the release of the baked item from the support frame for gravity dropping.
Figure 5:
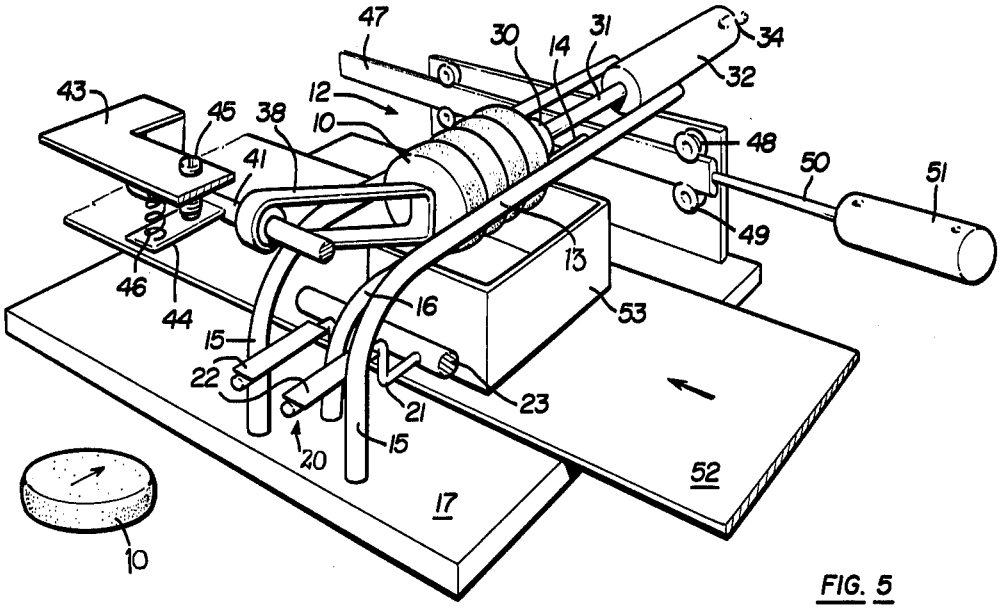
FIG. 5 is a perspective view of the basic elements which make up the stacking mechanism, including illustrating a box for receiving the stack.

FIG. 3 and 4 illustrate the operation of the transversely moveable rail for moving the bottom element from beneath the stack so that the stack may gravity fall. FIG. 3 shows the stack, looking endwise from the loading area towards the plunger (shown in dotted lines), with the stack supported upon the bottom element 14. FIG. 4 shows the bottom element 14 moved transversely due to movement of the rail 47 upon actuation of the cylinder 51. The stack is shown dropping downwardly for boxing purposes. Cylinder 51 is also commercially available. The Bimba Model 043-DB is an example of a commercially available cylinder for cylinder 51.

As can be seen, the mechanism herein can be used either by itself for forming one stack, or can be used in series, with more than one mechanism, i.e., two or four or more, as the case may be, for stacking a number of stacks simultaneously either for packaging all of these into one container or for simply making up multiple packages at one time.

The open nature of the mechanism, i.e., the simple rod-like elements including the loading arm, insures that the device will remain clean, and not catch dirt or pieces of the items should any break, and in addition makes cleaning of the mechanism a simple matter. This is important in the bakery industry or in similar industries where food is being handled.

Having fully described an operative embodiment of this invention, I now claim:

1. A horizontal stacker for relatively flattened, roughly disk shaped, soft items, such as baked muffins, doughnuts and the like baked goods, comprising:

an arm having a normally horizontal, load portion for receiving a horizontally arranged item to be stacked, and an opposite, pivotally mounted portion, and means for pivoting the arm for moving the load portion thereof into an upright position for thereby carrying the item into a roughly vertical position, i.e., rested upon an edge thereof;

a horizontally elongated support means having a load end for receiving and supporting said items as the items are placed thereon, one by one, by said arm;

a swinging barrier means located near the arm and the portion of said horizontal support means adjacent the arm of swinging above the support means and towards the support means in an arc which is generally aligned with the axis of the support means, whereby pivoting of the arm loaded with an item causes the barrier means to swing upwardly to clear the item and then to swing downwardly again to support the item against horizontal movement in the direction of the load end;

a force applying means for applying a horizontal force in a direction axial of the support means, i.e., towards the load end thereof, against the item furthest from the load end for compacting the stack of items against the barrier, with said force applying means moving in response to the addition of further items to the stack formed on the support means to maintain a relatively uniform low level force to the horizontal stack of items;

spaced apart guide means having portions being generally parallel to said horizontally elongated support means, said items being supported by said support means between said guide means, said support means and said guide means comprising wire-like elements arranged beneath and along the opposite sides of the stacked items;

and means for moving said wire-like support means in a direction parallel to the plane in which the wire-like guide means lie to thereby release the horizontally stacked items as a unit.

2. A horizontal stacker as defined in claim 1, and said force applying means comprising a piston means mounted upon a piston rod, for engaging the adjacent upright portion of an item, and means for applying a substantially uniform pressure on the piston rod, but permitting the piston rod and piston means to move in response to the addition of items to the stack.

3. A horizontal stacker as defined in claim 2, and said barrier comprising a narrow elongated flat strip having one end connected to a pivot and its end near said loading end being bent upwardly to form a substantially vertical stop portion, and with the strip sloping downwardly at an angle from the pivot towards the bent lower part of the stop portion, so that an item upon the arm engages the sloping portion of the strip to cause the strip to pivot upwardly, out of the way, for clearance of the item past the strip for thereby adding the item to the stack, and whereby the strip then drops back into its stop forming position.

* * * * *